US005903930A

United States Patent [19]

Huang

[11] Patent Number: 5,903,930

[45] Date of Patent: May 18, 1999

[54] TOILET CLEANSING AGENT DISPENSER

[76] Inventor: Fa-Tsia Huang, 1, Lane Tien Chien, Pai Sha Village, Hua Tan Hsiang, Changhua, Taiwan

[21] Appl. No.: 08/970,240

[22] Filed: Nov. 14, 1997

[51] Int. Cl.[6] ..... E03D 9/03

[52] U.S. Cl. ..... 4/227.4

[58] Field of Search ..... 4/227.1, 227.2, 4/227.3, 227.4

[56] References Cited

U.S. PATENT DOCUMENTS

| | | | |
|---|---|---|---|
| 2,587,388 | 2/1952 | Ryder | 4/227.3 |
| 4,696,414 | 9/1987 | Huat | 4/227.3 X |
| 5,429,270 | 7/1995 | Tumminia | 4/227.2 X |
| 5,734,996 | 4/1998 | Lee | 4/227.3 |

*Primary Examiner*—Charles E. Phillips

*Attorney, Agent, or Firm*—Smith, Gambrell & Russell, LLP; Beveridge, DeGrandi, Weilacher & Young Intellectual Property Group

[57] ABSTRACT

A toilet cleansing agent dispenser is composed of a cylindrical housing, an inner cylinder, a receiving body, a bolt rod, a base, a coil spring and a float piece. The bolt rod and the float piece are connected. The cylindrical housing is provided with a connection slide piece for fastening with a locating frame for mounting the dispenser in a toilet water tank. The float piece and the bolt rod are capable of up-and-down displacement in accordance with the water level in the toilet water tank, so as to regulate the flow of the toilet cleansing agent from the receiving body into the toilet water tank. As the water level in the toilet water tank rises to a certain level after the flush, the float piece and the bolt rod are caused to rise to seal off the flow hole of the receiving body so as to terminate the flow of the cleansing agent into the toilet water tank.

1 Claim, 6 Drawing Sheets

TOILET CLEANSING AGENT DISPENSER

FIELD OF THE INVENTION

The present invention relates generally to a cleansing agent dispenser, and more particularly to a toilet cleansing agent dispenser.

BACKGROUND OF THE INVENTION

The conventional way of cleansing a toilet bowl is done by flushing the toilet so that the water mixed with the cleansing agent is flushed out of the toilet water tank to cleanse the toilet bowl. Such a conventional cleansing method as described above is defective in design in that the concentration of the cleansing agent in each flush can not be regulated, thereby resulting in a waste of the cleansing agent.

SUMMARY OF THE INVENTION

The primary objective of the present invention is to provide a toilet cleansing agent dispenser free from the shortcoming of the prior art described above.

In keeping with the principle of the present invention, the foregoing objective of the present invention is attained by a toilet cleansing agent dispenser, which consists of a cylindrical housing, an inner cylinder, and a receiving body provided therein with a bolt rod, a base, a coil spring and a float piece. The dispenser is mounted inside the water tank of a toilet. The float piece and the bolt rod are capable of displacement in accordance with the water level in the toilet tank, so as to regulate the dispensing of the cleansing agent.

The foregoing objective, features, functions, and advantages of the present invention will be more readily understood upon a thoughtful deliberation of the following detailed description of an embodiment of the present invention with reference to the accompanying drawings.

DETAILED DESCRIPTION OF THE EMBODIMENT

Figure 1:
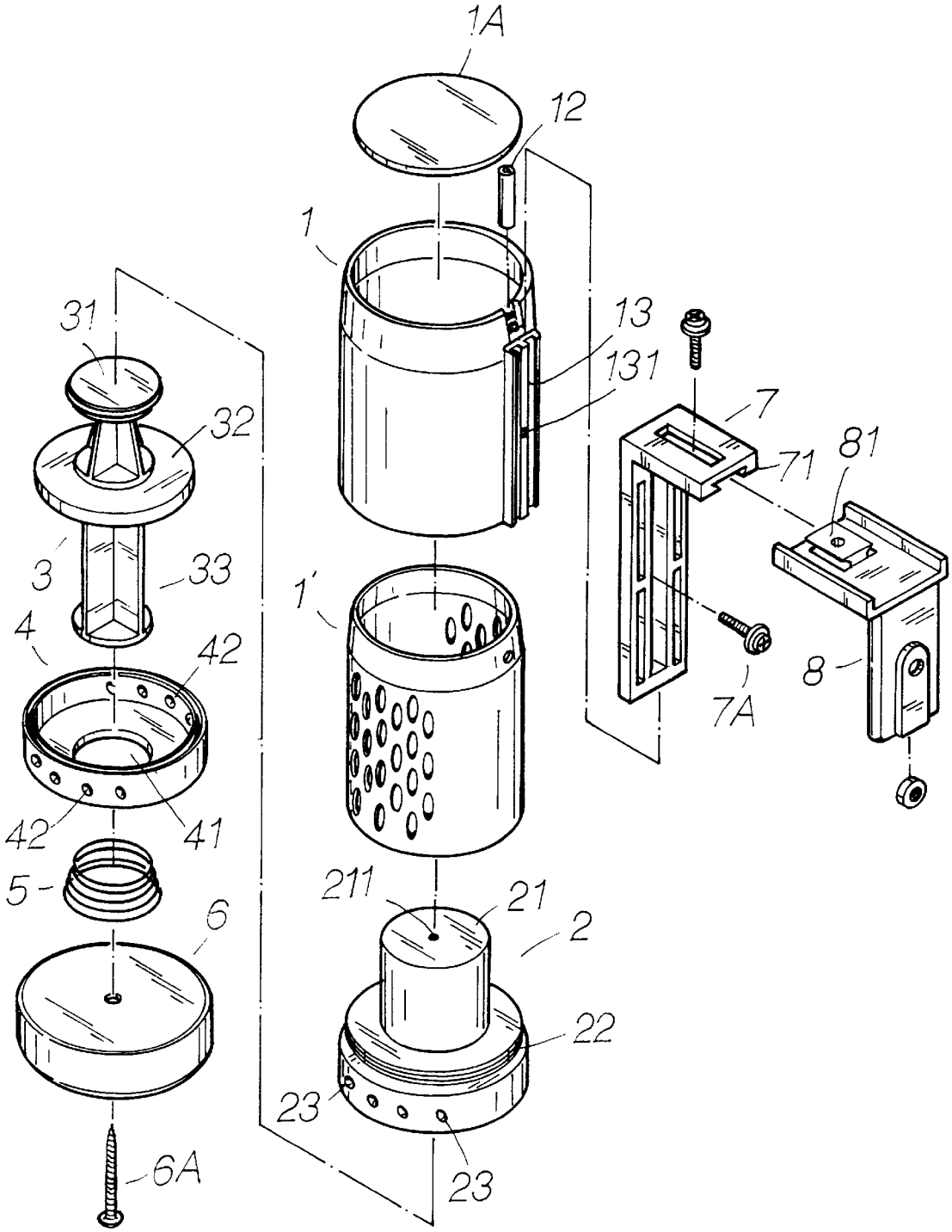
FIG. 1 shows an exploded view of the embodiment of the present invention.
Figure 2:
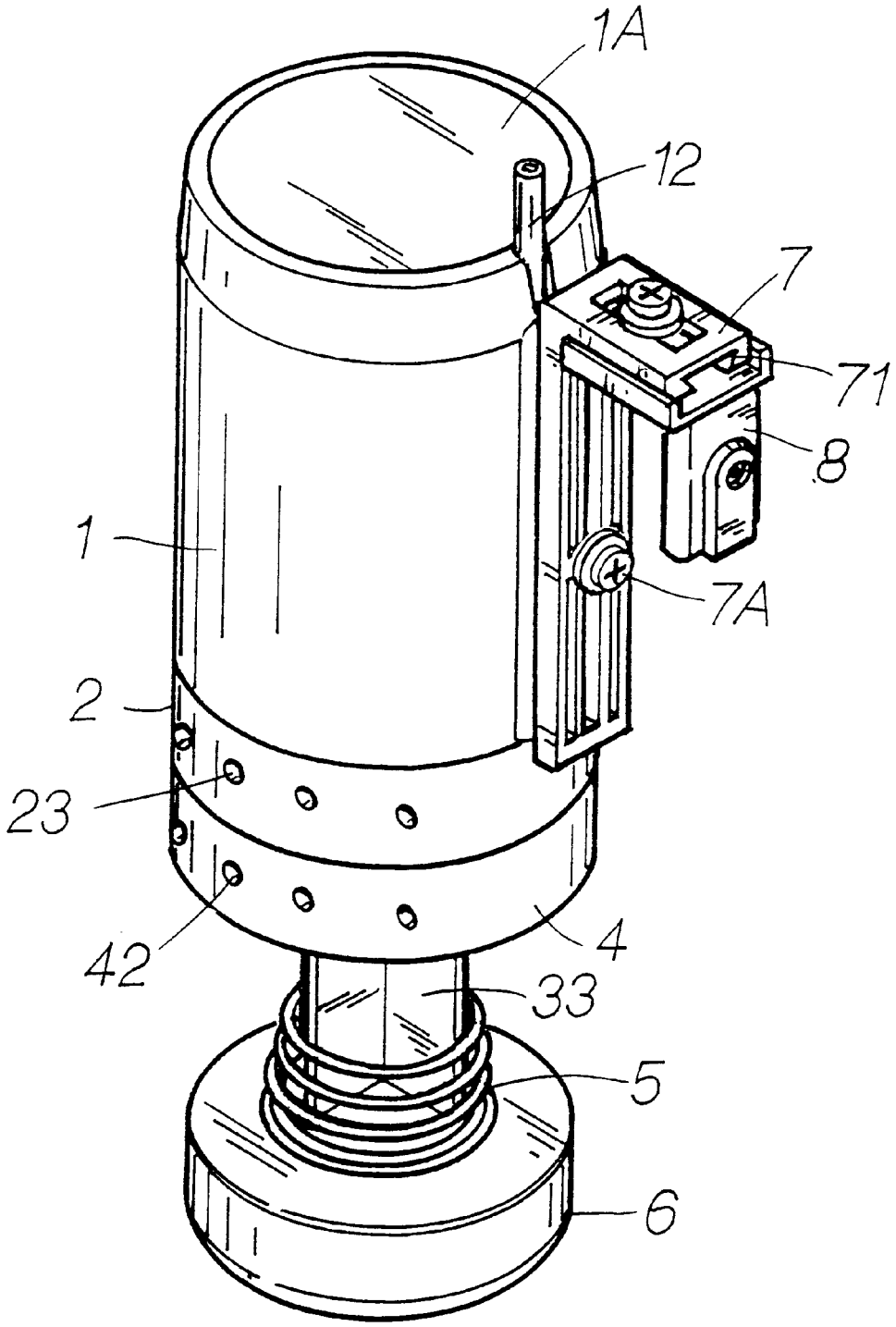
FIG. 2 shows a perspective view of the embodiment of the present invention in combination
Figure 4:
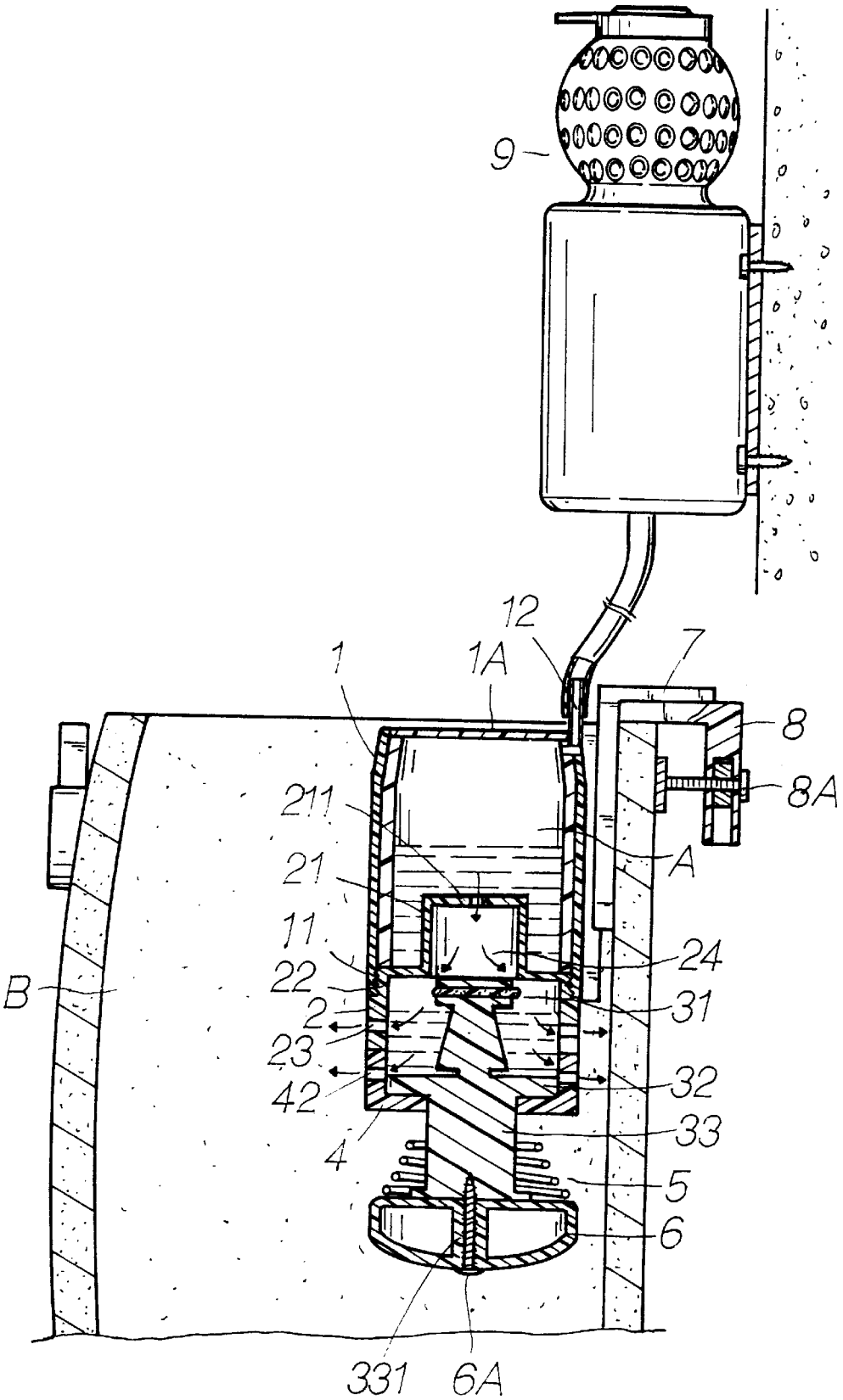
FIG. 4 shows a schematic view of the present invention in conjunction with a storage container for replenishing the present invention with the cleansing agent.
Figure 5:
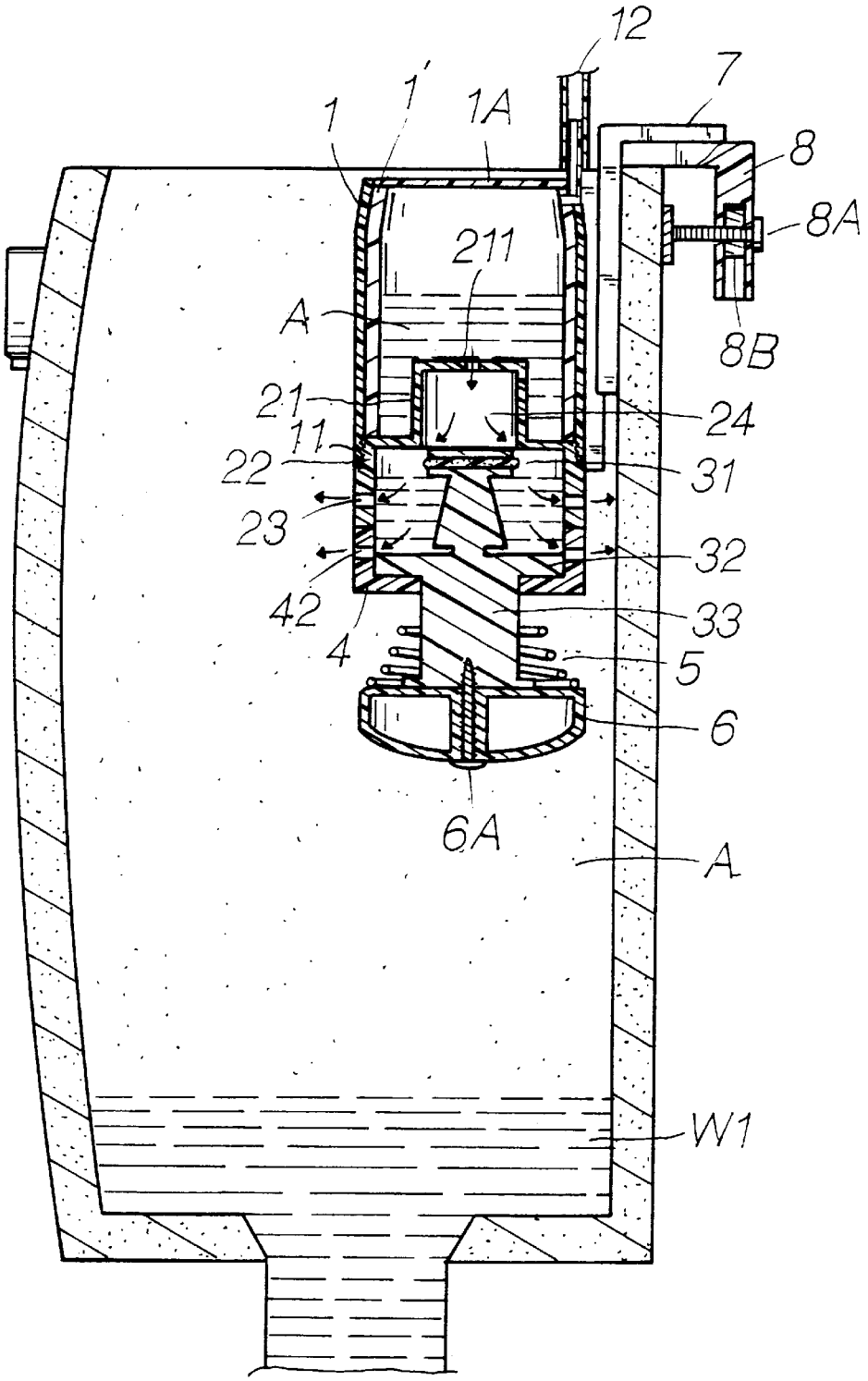
FIG. 5 shows a schematic view of the present invention at work.
Figure 6:
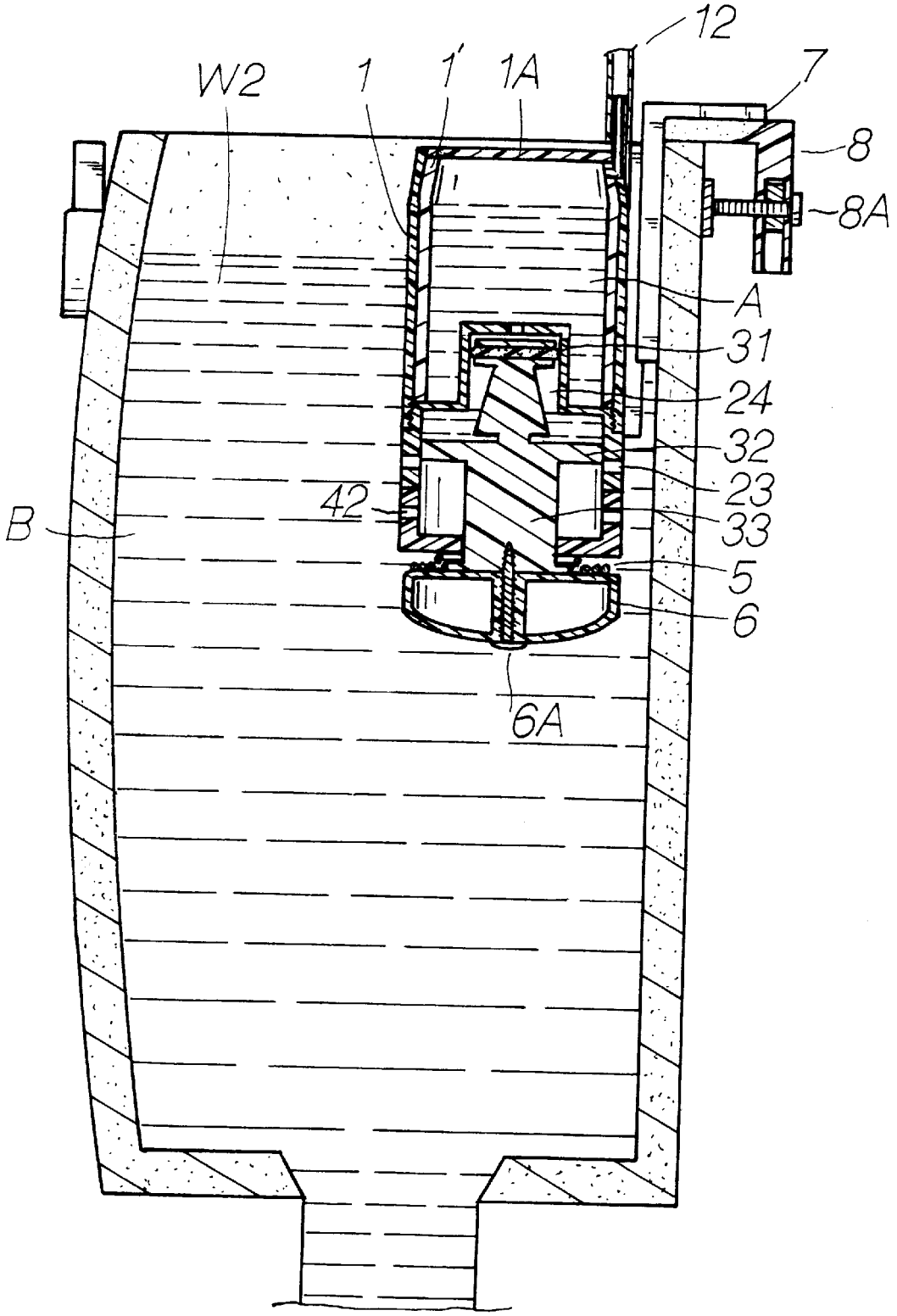
FIG. 6 shows another schematic view of the present invention at work.

As shown in FIGS. 1 and 2, a device embodied in the present invention for dispensing a toilet cleansing agent is composed of a cylindrical housing 1, an inner cylinder 1', and a receiving body 2 consisting of a cruciform bolt rod 3, a base 4, a coil spring 5 and a float piece 6. The cylindrical housing 1 is provided with an inner threaded portion 11, a cap 1A, and a connection tube 12 connecting the dispenser of the present invention with a cleansing agent reservoir 9, as shown in FIG. 4. The cylindrical housing 1 is further provided with a sliding piece 13 having a threaded hole 131 for use in fastening the cylindrical housing 1 with an L-shaped locating frame 7 by means of a bolt 7A which is engaged with the threaded hole 131 of the sliding piece 13. The locating frame 7 is provided in a short side thereof with a dovetail slot 71 capable of engaging a connection piece 81 of a movable slide plate 8 by means of a bolt. The movable slide plate 8 is provided in the vertical surface thereof with a nut 8B which is engaged with a locating blot 8A so as to enable the locating frame 7 and the movable slide plate 8 to be adjusted in location inside the toilet water tank 8. The receiving body 2 has a protruded body 21 which is provided with a flow hole 211 and threads 22 engageable with the inner threads 11 of the cylindrical housing 1. The receiving body 2 is to contain the cleansing agent A. The lower section of the receiving body 2 is provided in the periphery thereof with a plurality of round holes 23 and recess 24, as shown in FIGS. 4, 5 and 6 for locating the top piece 31 of the cruciform bolt rod 3 such that the flowing of the cleansing agent A is controlled by the contact of the top piece 31 with the flow holes 211. In addition, the bolt rod 3 is provided with an arresting ring 32 and a columnar body 33 is received in the hole 41 of the base 4 such that the columnar body 33 is arrested by the arresting ring 32. The columnar body 33 is put through the coil spring 5 to reach the float piece 6 and is fastened by a bolt 6A. The float piece 6 and the bolt rod 3 are connected such that they are capable of up-and-down motion. The hole 41 of the base 4 is provided with a plurality of round holes 42 allowing the cleansing agent A to flow into the water, in conjunction with the round holes 23 of the receiving body 2.

Figure 3:
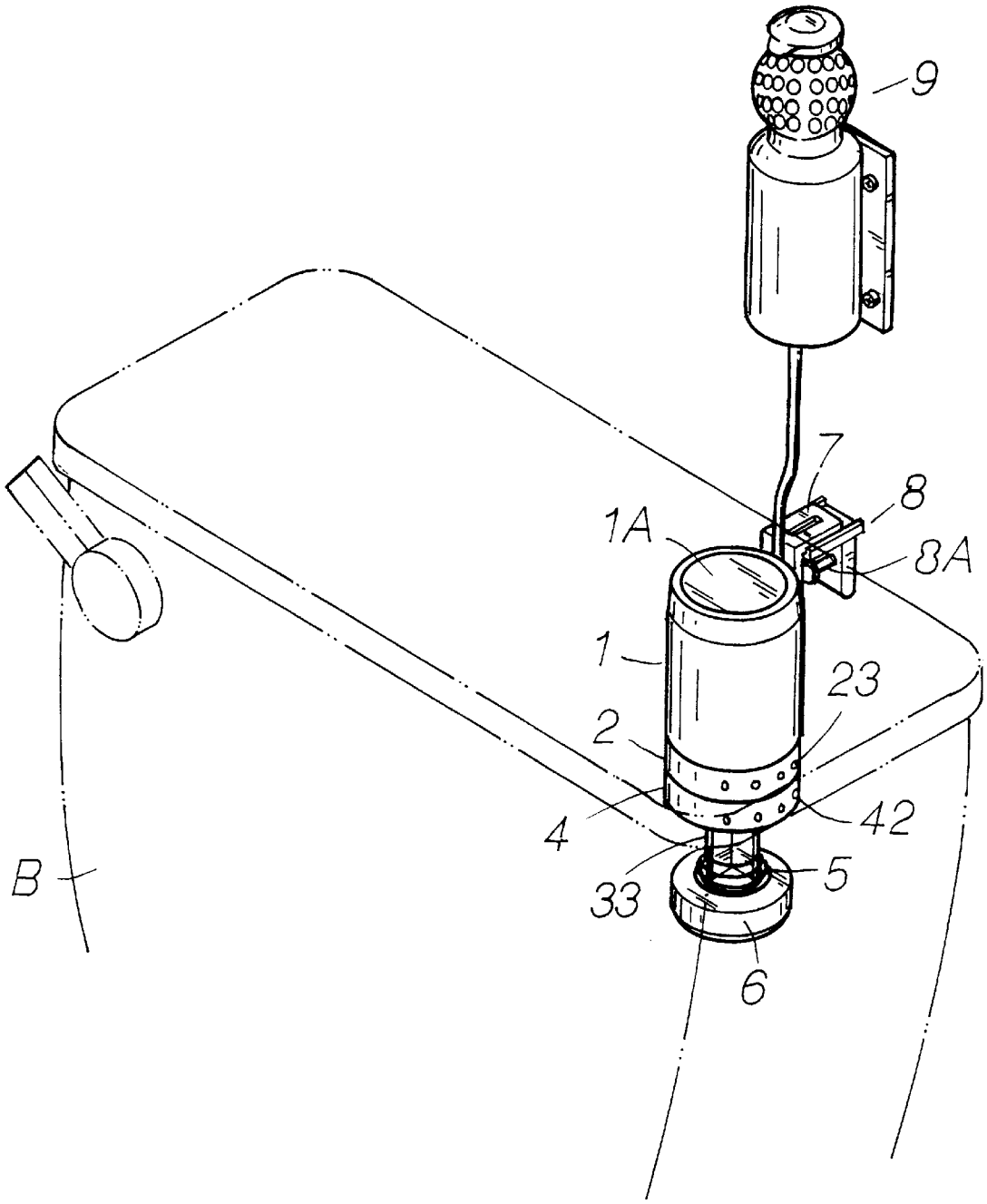
FIG. 3 shows a schematic view of the present invention in conjunction with a toilet water tank.

As shown in FIG. 3, the water level W1 in the water tank B is lowered under the float piece 6 by the flushing, the spring 5, the float piece 6 and the bolt rod 3 are caused to move lower, thereby causing the cleansing agent A of the cylindrical housing to flow from the flow holes 211 of the receiving body 2 to the recess 24 of the receiving body 2. When the top piece 31 of the bolt rod 3 moves away from the recess 24, the arresting ring 32 of the bolt rod 3 is located under the round holes 23 and 42 of the receiving body 2 and the base 4, thereby allowing the cleansing agent A to flow into the water W1 of the water tank B via the round holes 23 and 42 of the receiving body 2 and the base 4, as illustrated in FIGS. 4 and 5. As the water level rises to make contact with the underside of the float piece 6, the float piece 6 and the bolt rod 3 are caused to displace vertically such that the round holes 42 and 23 are sealed off by the arresting ring 32 of the blot rod 3, and that the top piece 31 returns again to the recess 24 of the receiving body 2 so as to stop the flow of the cleansing agent A. The water level W2 is now full of the cleansing agent A and is ready for another flush. When the water level W2 exceeds the upper side of the float piece 6, the spring 5 and the bolt rod 3 are caused to urge upwards to stop the supply of the cleansing agent A, as shown in FIG. 6. As the cleansing agent A is consumed, additional cleansing agent A is replenished from the reservoir 9, as shown in FIG. 4.

The embodiment of the present invention described above is to be regarded in all respects as being merely illustrative and not restrictive. Accordingly, the present invention may be embodied in other specific forms without deviating from the spirit thereof. The present invention is therefore to be limited only by the scope of the following appended claim.

What is claimed is:

1. A toilet cleansing agent dispenser comprising:

a cylindrical housing provided with inner threads, a cap, a connection tube in communication with a cleansing agent reservoir, and a connection slide piece provided with a threaded hole;

a locating frame fastened with said connection slide piece by a bolt engaged with said threaded hole of said connection slide piece, said locating frame having a short side provided with a dovetail slot for fastening with a movable slide plate by a bolt, said movable slide plate provided with a locating bolt and a nut for fastening said frame and said movable slide plate in a toilet water tank;

a receiving body, having a protruded body provided with a flow hole and threads engaged with said inner threads of said cylindrical housing, said receiving body having a receiving space for keeping a cleansing agent, said receiving body further provided with a plurality of round holes and a recess;

a cruciform bolt rod having a top piece located in said recess of said receiving body, said bolt rod further having an arresting ring and a columnar body provided with a threaded hole;

a coil spring fitted over said bolt rod;

a float piece fastened with said bolt rod by a fastening bolt engaged with said threaded hole of said columnar body of said bolt rod; and a base of a hollow construction and provided in a periphery thereof with a plurality of round holes, said base further provided with a center hole in which said columnar body of said bolt rod is received such that the cleaning agent is allowed to flow through said round holes of said receiving body at the time when said arresting ring of said bolt rod is caused to move in a predetermined direction.

* * * * *